US007059006B1

(12) United States Patent
Huff et al.

(10) Patent No.: US 7,059,006 B1
(45) Date of Patent: Jun. 13, 2006

(54) BRUSH WITH REMOVABLE PLATES OF TINES

(75) Inventors: L. Scott Huff, Aurora, IL (US); Steven Kwan, Hong Kong (HK)

(73) Assignees: Innovate LLC, Harbor Springs, MI (US); Merry Chance Industries, Ltd. (HK)

( * ) Notice: Subject to any disclaimer, the term of this patent is extended or adjusted under 35 U.S.C. 154(b) by 203 days.

(21) Appl. No.: 10/373,320

(22) Filed: Feb. 24, 2003

(51) Int. Cl.
*A46B 5/02* (2006.01)

(52) U.S. Cl. ..... 15/146; 15/150; 15/168; 15/176.5; 15/176.6; 15/178; 15/207.2

(58) Field of Classification Search ..... 15/168, 15/176.6, 207.2, 159, 146, 202, 178, 176.5, 15/150, 204; 206/209, 361, 362, 374
See application file for complete search history.

(56) References Cited

U.S. PATENT DOCUMENTS

| | | | | | |
|---|---|---|---|---|---|
| 2,326,879 | A | | 8/1943 | Neuhausen | 15/202 |
| 2,514,496 | A | | 7/1950 | Jones et al. | 15/223 |
| 2,912,709 | A | | 11/1959 | Carlson et al. | 15/178 |
| 2,943,341 | A | | 7/1960 | Dant | 15/202 |
| 3,344,457 | A | | 10/1967 | Grobert | 15/159 |
| 3,874,021 | A | | 4/1975 | Jacobs | 15/202 |
| 4,129,918 | A | * | 12/1978 | Lee | 15/169 |
| 4,469,223 | A | * | 9/1984 | Smith | 206/209 |
| 5,218,733 | A | | 6/1993 | Leu | 15/146 |
| 5,435,037 | A | | 7/1995 | Ledingham | 15/168 |
| 5,636,646 | A | * | 6/1997 | Zito | 132/149 |
| 5,701,629 | A | * | 12/1997 | O'Brien | 15/207.2 |
| 6,035,481 | A | | 3/2000 | Douglas et al. | 15/168 |
| 6,067,684 | A | * | 5/2000 | Kweon | 15/167.1 |
| 6,145,151 | A | * | 11/2000 | Herron et al. | 15/143.1 |
| 6,321,408 | B1 | | 11/2001 | Esterson et al. | 15/176.2 |
| 6,367,114 | B1 | | 4/2002 | Babkowski | 15/207.2 |
| 6,510,578 | B1 | | 1/2003 | Cyr et al. | 15/176.6 |

* cited by examiner

*Primary Examiner*—Gladys J. P. Corcoran
*Assistant Examiner*—Abraham Bahta
(74) *Attorney, Agent, or Firm*—Barnes & Thornburg LLP; Timothy J. Engling

(57) ABSTRACT

A brush including removable plates with tines that can be inserted into a complementary handle. The plates, made up of tines connected to a manifold at one end, are retained by the handle. Removable flat plates can be of a unitary construction and can be rolled, stacked or folded upon one another to form layers of tines. The plates are designed to be easily separated from a brush after use to allow for cleaning or replacement. The plates may also be interconnected by a set of hinges. The tines may include a plurality of flutes or ribs that increase the surface area of the tines and aid in increasing liquid retention when the brush is being used. After use, the individual plates can be removed from the handle and easily cleaned.

16 Claims, 6 Drawing Sheets

BRUSH WITH REMOVABLE PLATES OF TINES

BACKGROUND OF THE INVENTION

The present invention relates to a brush that includes removable plates with tines that can be inserted into a complementary handle. Preferably, the tines are integral with the plates.

Brushes used for applying liquids such as paint, barbecue sauces or even sealant for blacktop driveways are typically manufactured as a complete one-piece assembled unit that is sold with the handle permanently connected to the bristles. After the brush is utilized to coat a particular object with a desired liquid, it is either cleaned or discarded. Cleaning the brushes is difficult when the liquid adheres between the bristles and requires intensive soaking in cleaning solutions to remove the liquid so that the brush can be readied for reuse. Typically, many brushes are so difficult to clean and maintain that they are discarded by the user. Further, food basting brushes that trap food and sauces within the bristles allow bacteria to grow, potentially causing illness. Brushes with bristles that can be removed require complex attachment mechanisms and typically are still difficult to clean after the brushes are disassembled due to the fact that the bristles are still too abundant within the bristle segment to allow for easy cleaning.

Prior art brushes do not provide for a brush having removable integral plates of tines that can be easily assembled and disassembled for cleaning purposes and manufactured in a cost-effective manner.

SUMMARY OF THE INVENTION

The present invention is a brush that comprises removable plates with tines that can be inserted into a complementary handle. The plates, made up of tines connected to a manifold at one end, are retained by the handle. The removable plates are of a unitary construction, and can be rolled, stacked or folded upon one another to form layers of tines. The plates are preferably substantially flat. The plates are designed to be easily separated or flattened after use to allow for cleaning and replacement if the tines should become damaged. The plates may also be interconnected by a set of hinges. The tines further may include a plurality of flutes or ribs that aid in liquid retention when the brush is being used. After use, the plates can be removed from the handle and easily cleaned. Since the plates are manufactured from a unitary piece of material preferably by compression molding, the fabrication costs are low.

These and other aspects of this invention are illustrated in the accompanying drawings and are more fully described in the following specification.

BRIEF DESCRIPTION OF THE DRAWINGS

The above mentioned and other features of this invention and the manner of obtaining them will become more apparent, and the invention itself will be best understood by reference to the following description of embodiments of the invention taken in conjunction with the accompanying drawing in which.

DETAILED DESCRIPTION OF THE INVENTION

While the present invention will be described fully hereinafter with reference to the accompanying drawings, in which particular embodiments are shown, it is to be understood at the outset that persons skilled in the art may modify the invention herein described while still achieving the desired result of this invention. Accordingly, the description that follows is to be understood as a broad informative disclosure directed to persons skilled in the appropriate art and not as limitations of the present invention.

Figures 1, 2:
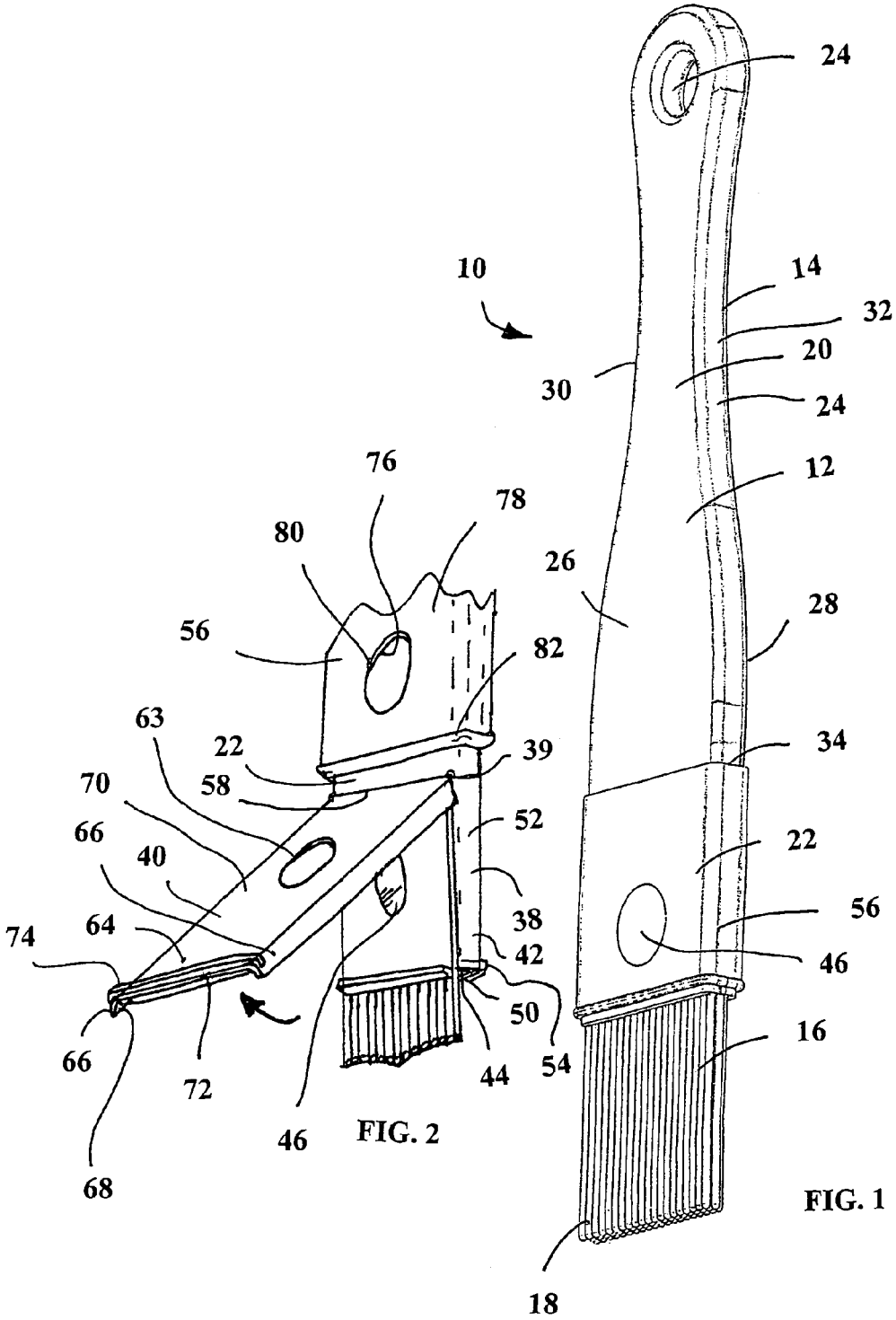
FIG. 1 is a perspective view of a brush with removable plates of tines.
FIG. 2 is a perspective view illustrating an open member allowing the removal of the plates from the handle.
Figure 3:
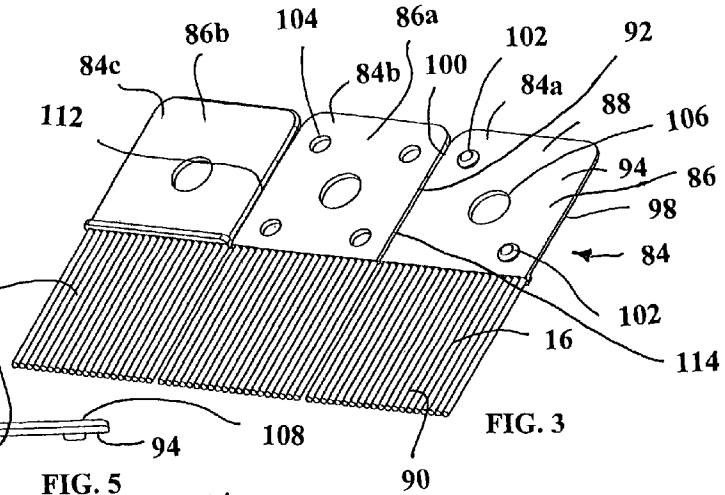
FIG. 3 is a perspective view illustrating three plates.
Figure 5:
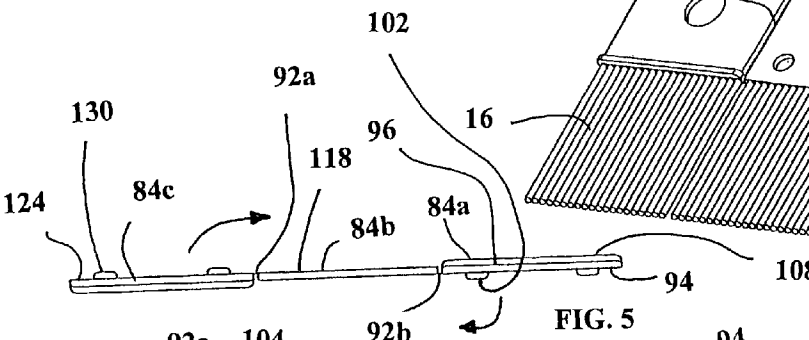
FIG. 5 is a top elevational view of the plates of FIG. 3.
Figure 6:
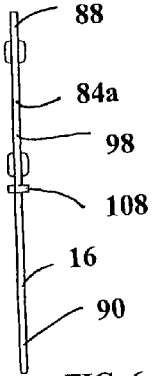
FIG. 6 is a side elevational view of the plates of FIG. 3.
Figure 4:
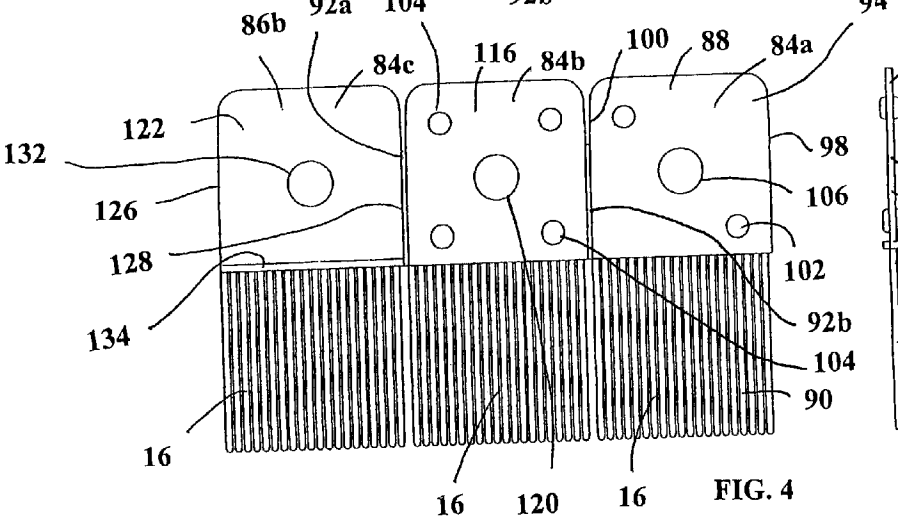
FIG. 4 is a front elevational view of the plates of FIG. 3.

In the figures, like reference numerals indicate the same elements throughout. FIG. 1 shows a brush 10 comprising a handle 12 at a first end 14 and a plurality of tines or bristles 16 at a second end 18. The brush 10 is adapted to be utilized for the application of a liquid such as paint, varnishes, barbeque sauce, blacktop sealant, and the like. The brush 10 is designed so that the tines 16 can be easily removed from the handle 12 and disassembled for easy cleaning after the application of the liquid is completed. The handle 12 includes a grip 20 and a base 22. The handle 12 includes a first side 26 and an opposite second side 28, wherein the first side 26 and second side 28 may be parallel. The grip 20 is an elongated portion of the handle 12 that tapers at a mid-section 24 along a third and fourth side 30 and 32 to allow for the user to easily grab the handle 12 while using the brush 10. The handle 12 may further include an aperture 24 that allows the brush 10 to be easily supported by a hook or other support device when the brush 12 is not in use.

The base 22 of the handle 12 is adapted to retain the tines 16 as shown in FIGS. 1 and 2. The base 22 is connected to the grip 20 at a first end 34 and adapted to receive the tines 16. The base 22 preferably includes a stationary first retaining member 38 and a hinged second retaining member 40. The first retaining member 38 is affixed to the grip 20 at a first end 39 by use of adhesive, brads, staples or other means know to those skilled in the art. The first retaining member 38 may also be molded with the handle 12. The first retaining member 38 includes a base wall segment 50 and a pair of side wall segments 52, which are perpendicularly oriented to and extend outwardly from the base wall segment 50. The first retaining member 38 further includes an outside surface 42 and an inside surface 44. The base wall segment 50 of the first retaining member 38 includes a detent lug 46 or similar projection that extends outwardly from the inside surface 44 thereof. The detent lug 46 is adapted to aid in the retention of the tines 16 to the base 22. The base wall segment 50 of the first retaining member 38 may include a channel (not shown) that is adapted to aid in the retention of the tines 16 to the base 22. The first retaining member 38 also includes a ledge 54 that extends outwardly from the outside surface 42. The ledge 54 is adapted to restrict the forward movement of a sleeve 56 that is associated with the handle 12.

The second retaining member 40 is hingedly connected to the grip 20 at a first end 58 and adapted to retain the tines 16. The second retaining member 40 is hinged to allow the second retaining member 40 to be pivoted away from the first retaining member 38 for the removal of the tines 16. The second retaining member 40 includes a base wall segment 64 and a pair of side wall segments 66 that extend outwardly from and are oriented perpendicular to the base wall segment 64. The second retaining member 40 further includes an inside surface 68 and an outside surface 70. The second retaining member 40 may include an annular recess (not shown) that is adapted to accept the lug detent 46 from the first retaining member 38. The second retaining member 40 may also include an aperture 63 that allows for the detent lug 46 of the first retaining member 38 to pass therethrough. The inside surface 68 of the second retaining member 40 may include an inwardly extending lip 72 that is adapted to retain the tines 16. The outside surface 70 of the second retaining member 40 includes a ledge 74 that is adapted to limit the forward movement of the sleeve 56, when the sleeve 56 is moved toward the tines 16 to secure the first retaining member 38 and second retaining member 40.

The sleeve 56 is positioned around the handle 12 and is adapted to retain the first retaining member 38 and second retaining member 40 together to secure the tines 16 to the handle 12. The sleeve 56 includes an inside surface 76 and an outside surface 78, as shown in FIG. 2. The outside surface 78 is adapted to be gripped by the user and slid rearwardly away from the tines 16 to allow the second retaining member 40 to be opened allowing, release of the tines 16. The inside surface 76 is adapted to slide along the handle 12 and engage the first and second retaining members 38 and 40. The sleeve 56 may include an aperture 80 that is adapted to accept the detent lug 46 of the first retaining member 38 to prevent unwanted sliding of the sleeve 56 when in the forward position. The sleeve 56 may include a raised ridge 82 that prevents the user's hands from sliding off of the outside surface 78 when the sleeve 56 is moved to the forward position.

The tines 16 of the brush 10 are part of a series of plates 84 that are stacked or folded together to form layers of tines 16. The plates 84, as shown in FIGS. 3–7, are preferably fabricated from a silicone polymer material that has desirable heat resistance and anti-adhesion properties. In addition to silicone polymers, other polymers may be used to fabricate the plates 84, such as thermoplastic rubbers. The plates 84 include a manifold 86 at a first end 88 and the tines 16 at a second end 90. The tines 16 and the manifold 86 of each plate 84 are of a unitary construction allowing the plates 84 to be fabricated from a single type of material by die cutting, compression molding, injection molding or other molding methods known to those skilled in the art. The preferred compression molding allows the single molded unit to have tines 16 extending from an end of a plate 84 in one integral piece.

FIGS. 3–6 illustrate three plates 84*a*, 84*b* and 84*c* interconnected by living hinges 92*a* and 92*b* that allow the plates 84*a*–*c* to be folded upon each other to form layers of tines 16. In place of hinges, any jointed or flexible device that allows pivoting may be used. While FIGS. 3–6 illustrate three interconnected plates 84 additional plates 84 may be used to increase the thickness of the brush 10. The three plates 84*a*–*c* are preferably molded as one unitary piece, but can be molded as individual plates if desired.

The first plate 84*a* includes a first side surface 94, a second side surface 96, a first edge 98 and a second edge 100. The first plate 84*a* includes a pair of pegs or bosses 102 extending outwardly from the first side surface 94 of the manifold 86. The pegs 102 are adapted to be positioned within a complementary pair of apertures 104 of the second plate 84*b* to maintain the alignment of the first plate 84*a* with the second plate 84*b*. The first plate 84*a* also includes an opening 106 that passes through the manifold 86 that is adapted to allow the detent lug 46 to pass therethrough, retaining the first plate 84*a* to the handle 12. The first edge 98 of the first plate 84*a* is adapted to be positioned against the side wall segments 52, 66 when the plate 84*a* is positioned between the retaining members 38 and 40. The second side surface 96 of the first plate 84*a* may include a ledge 108 that extends along the width of the manifold 86 and is adjacent the tines 16. The ledge 108 is adapted to be positioned within a groove (not shown) located on the inside surfaces 44, 68 of the first and second retaining members 38 and 40. The second edge 100 of the first plate 84*a* is attached to the living hinge 92*b*, which allows the first plate 84*a* to be pivoted onto the second plate 84*b*.

The second plate 84*b* is similar to the first plate 84*a* in that the second plate 84*b* also includes a manifold 86*a* and a plurality of tines 16. The second plate 84*b* includes a first edge 112 and a second edge 114. In this embodiment, both edges 112, 114 are hingedly connected to the first and third plates 84*a*, 84*c* by use of hinges 92. The second plate 84*b* further includes a first side surface 116 and a second side surface 118. The first side surface 116 of the second plate 84*b* is adapted to be in contact with the first side surface 94 of the first plate 84*a* when the two plates are folded together. The manifold 86 of the second plate 84*b* includes the apertures 104 that are adapted to accept the pegs 102 of the first plate 84*a*. The second plate 84*b* further includes an opening 120 that is adapted to accept the detent lug 46 to retain the second plate 84*b*.

The third plate 84*c* is similar to the first and second plates 84*a* and 84*b* in that the third plate 84*c* includes a manifold 86*b* and a plurality of tines 16. The third plate 84*c* includes a first side surface 122, a second side surface 124, a first edge 126 and a second edge 128. The third plate 84*c* includes a pair of pegs or bosses 130 extending outwardly from the second side surface 124 of the manifold 86*b*. The pegs 130 are adapted to be positioned within the apertures 104 of the second plate 84*b* to maintain the alignment of the third plate 84*c* with respect to the second plate 84*b*. The third plate 84*c* also includes an opening 132 that passes through the manifold 86*b* and is adapted to allow the detent lug 46 to pass therethrough, retaining the third plate 84*c* to the handle 12. The first edge 126 of the third plate 84*c* is adapted to be positioned against the side wall segments 52, 66 when the third plate 84*c* is positioned between the first and second retaining members 38 and 40. The first side surface 122 of the third plate 84*c* includes a ledge 134 that extends along the width of the manifold 86*b* and is positioned adjacent the tines 16. The ledge 134 is adapted to be positioned within the grooves (not shown) located on the inside surfaces 44, 68 of the first and second retaining members 38, 40. The second edge 128 of the third plate 84*c* is attached to the living hinge 92, which allows the third plate 84*c* to be pivoted onto the second plate 84*b*.

The tines 16 are molded with the manifold 86 to form the plates 84. The tines 16 are elongated flexible members adapted to allow for a liquid to be transferred from a container to an object such as grilled food.

Figure 7:
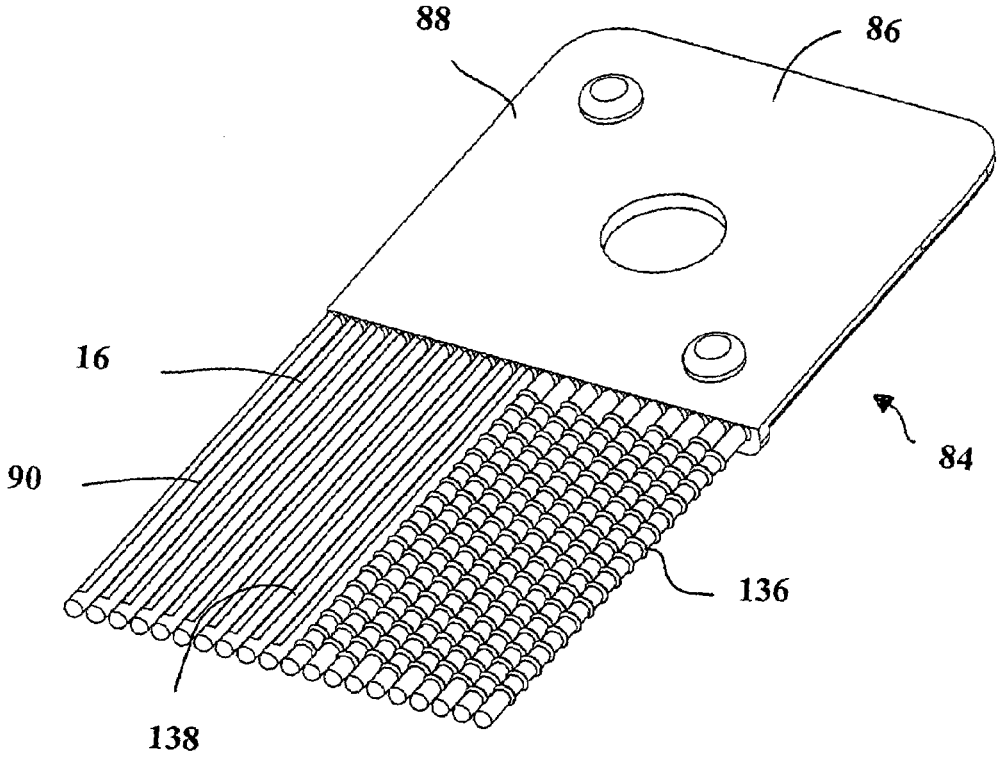
FIG. 7 is a perspective view of a plate illustrating two preferred embodiments of tines.

FIG. 7 shows a manifold 86 with two variations of tines 16 extending out of an end. To enhance the ability of the tines 16 to retain liquid, the outer surface of the tines 16 may include ribs 136 or flutes 138, which increases the surface area of each tine 16, enabling the tines 16 to retain more liquid. The ribs 136 are shown as orbiting rings, but they may also run parallel to each tine 16. While ribbing and fluting are preferred, other types of grooving or raised surfaces may be added to the tines 16 to increase liquid retention.

FIG. 7 shows a single plate that be interlocked with other complementary plates. Although integral hinged plates are preferred, the scope of this invention covers separate plates that are stacked. Any combination of cylindrical, fluted or ribbed tines 16 can be made.

Figure 8:
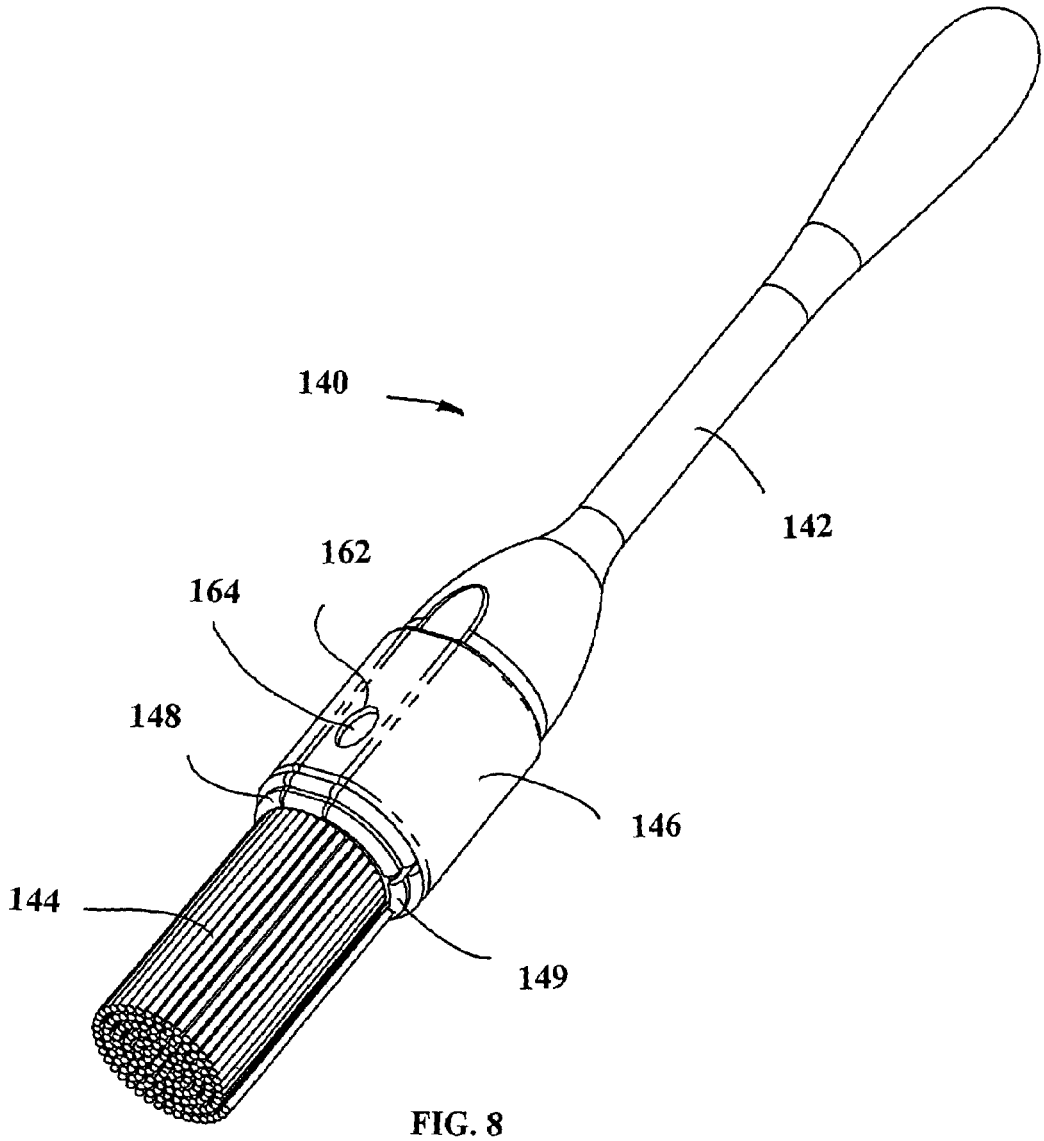
FIG. 8 is a perspective view of another embodiment of a brush with a removable plate of tines.

FIG. 8 illustrates an alternate embodiment of a brush 140 having a handle 142 at one end and a plurality of tines 144 at a second end. The handle 142 includes a sleeve 146 and a pair of hinged retaining members 148, 149, adapted to retain the tines 144.

Figure 9:
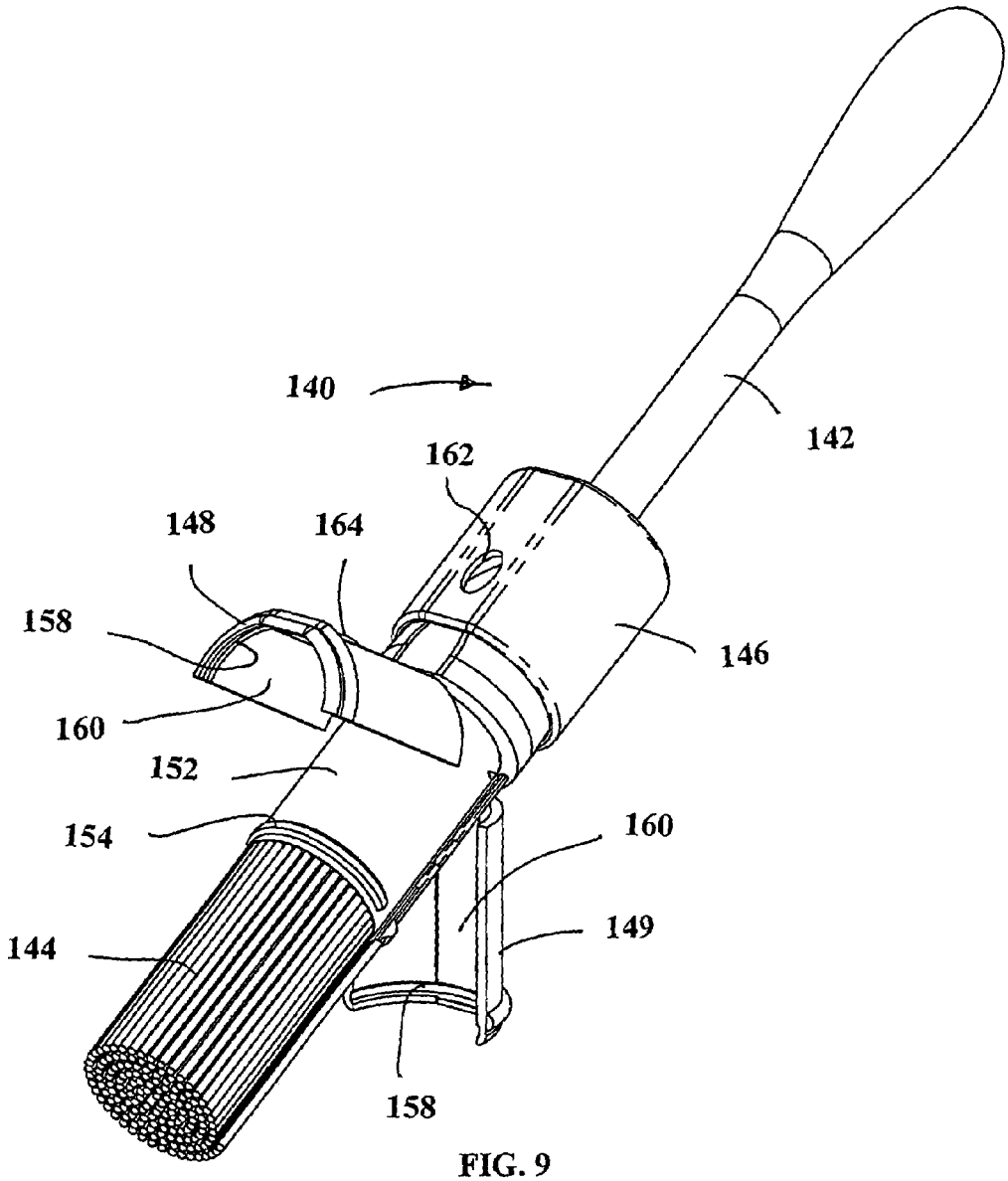
FIG. 9 is a perspective view of illustrating a pair of retaining members in an open position allowing the removal of the rolled plate from the handle.
Figure 10:
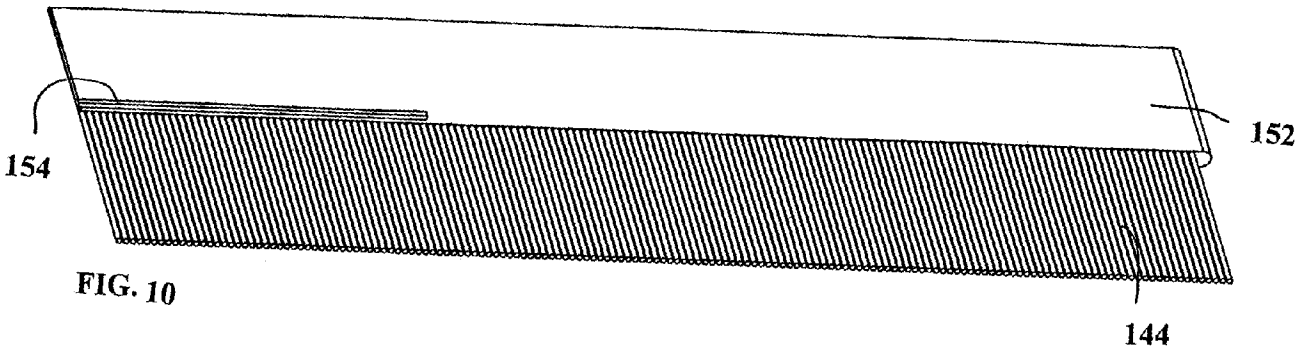
FIG. 10 is a perspective view illustrating a plate having a manifold and tines attached thereto.
Figure 11:
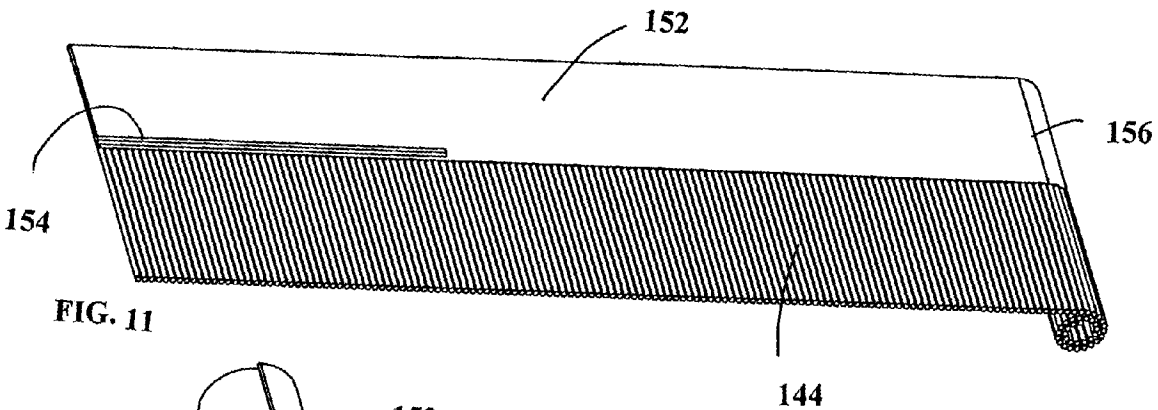
FIG. 11 is a perspective view illustrating the plate partially rolled at one end.
Figure 12:
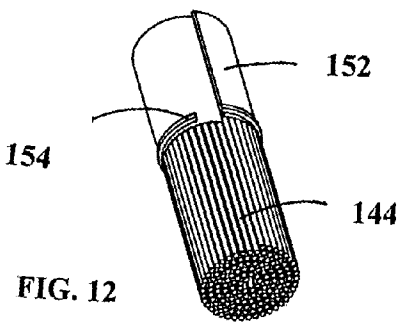
FIG. 12 is a perspective view illustrating the plate completely rolled.

FIG. 9 illustrates the brush 140 with the sleeve 146 slid away from the tines 144 and the hinged retaining members 148, 149 in an open position, allowing the removal of the plate 150, which comprises a manifold 152 at one end and the plurality of tines 144 at a second end. The manifold 152 and the tines 144 that make up the plate 150 are of a unitary construction and are manufactured from the same material. The plate 150, as shown in FIG. 10, has an elongated manifold 152 that includes a ledge 154 that extends outwardly from a portion of the manifold 152. To prepare the plate 150 for installation into the handle 142, the plate 150 is rolled by starting at a first end 156, as shown in FIG. 11. The plate 150 is rolled until a cylindrical shape is formed, as shown in FIG. 12. Upon completion of the rolling process, the ledge 154, is positioned around a portion of the perimeter of the manifold 152. Once the plate 150 is rolled, the plate 150 is positioned between the retaining members 148, 149.

Once the rolled plate 150 is positioned between the retaining members 148, 149, the retaining members 148, 149 are pivoted to the closed position, wherein a groove 158 on the inside surface 160 of the retaining members 148, 149 engages the ledge 154 of the plate 150. After the retaining members 148, 149 are positioned around the plate 150, the sleeve 146 is slide towards the tines 144. When the sleeve 146 is moved to its most forward position, an aperture 162 in the sleeve 146 engages a detent 164 on the outer surface of the retaining member 148. The detent lug 164 is adapted to aid in the retention of the tines 144 to the handle 142.

Although the preferred embodiment of the invention is illustrated and described in connection with particular features, it can be adapted for use with a variety of brushes. Other embodiments and equivalent brushes and methods are envisioned within the scope of the invention. Various features of the invention have been particularly shown and described in connection with the illustrated embodiments of the invention, however, it must be understood that these particular embodiments merely illustrate and that the invention is to be given its fullest interpretation within the terms of the appended claims.

What is claimed is:

1. A brush having removable tines comprising:

a plurality of interconnected plates each having a manifold connected to a plurality of tines, the plates adapted to be stacked to form layers;

a handle including an attachment mechanism adapted to allow the plates to be attached and removed from the handle, wherein the attachment mechanism comprises a first retaining member having a detent lug, the first retaining member is connected to the handle;

a second retaining member pivotally connected to the handle; and a sleeve surrounding the handle and adapted to be positioned around the first and second retaining members;

wherein the plurality of plates is formed from a single unitary piece of polymeric material.

2. The brush of claim 1 wherein the plurality of plates includes an alignment mechanism to enable the plates to maintain correct alignment when stacked.

3. The brush of claim 1 wherein at least two of the plurality of plates are pivotally interconnected by a living hinge that is part of the single unitary piece of polymeric material.

4. The brush of claim 3 wherein the sleeve is slidable when the plurality of interconnected plates is attached to the handle.

5. The brush of claim 1 wherein the plates are formed from a silicone polymer.

6. The brush of claim 1 wherein the plurality of interconnected plates is compression molded.

7. The brush of claim 1 wherein the tines include flutes to aid in liquid retention.

8. The brush of claim 1 wherein the tines include ribs to aid in liquid retention.

9. A liquid applicator comprising:

a first plate having a first plurality of tines attached at one end to a first manifold, the first manifold including at least one outwardly extending first projection;

a second plate having a second plurality of tines attached at one end to a second manifold, the second manifold including a plurality of openings adapted to accept the first projection from the first plate, when the first plate is adjacent the second plate;

a third plate having a third plurality of tines attached at one end to a third manifold, the third manifold including at least one outwardly extending second projection, the second projection adapted to be positioned within at least one of the plurality of openings of the second plate, when the third plate is adjacent the second plate;

a first living hinge between the first plate and the second plate and a second living hinge between the second plate and the third plate;

wherein the first, second and third plates are interconnected by the living hinges that are unitary with adjacent plates;

wherein the manifold and tines of each of the plates are unitary and made from the same material.

10. The liquid applicator of claim 9 wherein the plates are releasably connected to a handle.

11. The liquid applicator of claim 9 wherein the plates are interconnected by the living hinges that are unitary with two of the first, second and third plates and the living hinges are constructed from a same polymeric material as the first, second and third plates.

12. The liquid applicator of claim 11 wherein the first plate can be folded onto the second plate and the third plate can be folded onto the second plate.

13. The liquid applicator of claim 9 further comprising a handle and a slidable sleeve surrounding the handle, wherein the slidable sleeve can slide over the manifolds of the first, second and third plates when inserted in the liquid applicator.

14. The liquid applicator of claim 9 wherein the plates are compression molded.

15. The liquid applicator of claim 9 wherein the tines include flutes to aid in liquid retention.

16. The liquid applicator of claim 9 wherein the tines include ribs to aid in liquid retention.

* * * * *